US008215063B1

(12) United States Patent
Francis

(10) Patent No.: US 8,215,063 B1
(45) Date of Patent: Jul. 10, 2012

(54) GUARD RAIL LOCK ASSEMBLY

(75) Inventor: Einstein B. Francis, Archbold, OH (US)

(73) Assignee: biljax, inc., Archbold, OH (US)

( * ) Notice: Subject to any disclaimer, the term of this patent is extended or adjusted under 35 U.S.C. 154(b) by 447 days.

(21) Appl. No.: 12/583,986

(22) Filed: Aug. 28, 2009

Related U.S. Application Data

(60) Provisional application No. 61/192,170, filed on Sep. 16, 2008.

(51) Int. Cl.
*E04C 3/10* (2006.01)

(52) U.S. Cl. ..... 52/6; 52/775; 403/109.6

(58) Field of Classification Search ..... 52/6, 7, 52/775; 224/323, 331; 211/189, 192; 410/104, 410/105; 403/109.1–109.6, 109.8, 166
See application file for complete search history.

(56) References Cited

U.S. PATENT DOCUMENTS 4,759,162 A 7/1988 Wyse
4,942,708 A * 7/1990 Krumholz et al. ..... 52/263
5,205,087 A * 4/1993 Jines ..... 52/6
5,323,563 A 6/1994 Rogers et al.
5,613,450 A 3/1997 Wagner et al.
5,791,536 A * 8/1998 Stapleton ..... 224/321
5,848,501 A 12/1998 Taipale et al.
6,024,026 A 2/2000 Botts et al.
6,070,367 A 6/2000 Wagner et al.
6,164,016 A 12/2000 Bue et al.

OTHER PUBLICATIONS

US 5,232,564, 06/1994, Mensching et al. (withdrawn)

* cited by examiner

*Primary Examiner* — Jeanette E Chapman
*Assistant Examiner* — Daniel Kenny
(74) *Attorney, Agent, or Firm* — Emch, Schaffer, Schaub & Porcello Co., L.P.A.

(57) ABSTRACT

This performance stage frame member has a shaped cross-section. The frame member comprises a vertically extending back surface and an outwardly extending shape defining a multifaceted cavity therebetween. The invention also includes a lock assembly comprising an interlocking shape is configured to engage the multifaceted cavity of the outwardly extending shape of the frame member.

14 Claims, 6 Drawing Sheets

GUARD RAIL LOCK ASSEMBLY

CROSS REFERENCE TO RELATED APPLICATION

This application claims the benefit of U.S. Provisional Application Ser. No. 61/192,170, filed Sep. 16, 2008.

TECHNICAL FIELD

This invention relates to a performance stage frame member and lock assembly. The performance stage deck is for theatrical or musical events. The guard rail lock assembly holds the guard rail panel in place on the performance stage. The guard rail lock also may hold stairs in place on the stage.

BACKGROUND OF THE INVENTION

A substantial need exists for performance stage deck assemblies which can be relatively quickly assembled and dismantled for temporary use but which also have strength and durability for longer term use. A modular platform assembly includes rectangular, preferably squared deck sections which can be employed in virtually any number to provide platforms or stages of any desired shape and area. Each of the deck sections has a rectangular metal frame to which is affixed wooden sheeting or the like. Contiguous sides of the frame have interlocking means by which adjacent sections can be readily connected, with the sheeting forming a smooth unbroken stage or deck surface.

While the current design of the staging provides satisfactory results, there is a demand for improvement, specifically with flat top surfaces with horizontal alignment. The frame member and lock assembly of the following invention provides for easy assembly. One person can assemble the stage.

SUMMARY OF THE INVENTION

The performance stage assembly of the present invention includes a combination of deck sections integrally joined together, creating a platform of desired size and shape. Each deck section includes a deck panel supported by a frame. The frames are constructed from unique horizontal frame members having a shaped cross-section wherein the frame member includes a top lip and a chamfer extending from the top lip. The frame member also comprises a vertically extending back surface with the top lip extending inwardly and horizontally from the back surface. The frame member further comprises a bottom lip extending inwardly and horizontally from the back surface.

The frame member further comprises a C-shaped section extending from the back surface of the frame member. The C-shaped section includes an elongated member, a top lip and a bottom lip. The elongated member, top lip and bottom lip of the C-shaped section are perpendicular to the back surface of the frame member. The guard rail lock latch of the guard rail lock assembly engages the C-shaped section.

The guard rail lock assembly further comprises a tube-guard rail lock. As a result, the guard rail lock assembly secures the guard rail panel to the frame member.

Other objects and advantages of the present invention will become apparent to those skilled in the art upon a review of the following detailed description of the preferred embodiments and the accompanying drawings.

DETAILED DESCRIPTION OF THE INVENTION

The performance stage frame member of this invention has a shaped cross-section and lock assembly. The frame member comprises a vertically extending back surface and an outwardly extending shape defining a multifaceted cavity therebetween. The lock assembly comprises an interlocking shape wherein the interlocking shape is configured to engage the multifaceted cavity of the outwardly extending shape of the frame member.

Figure 1:
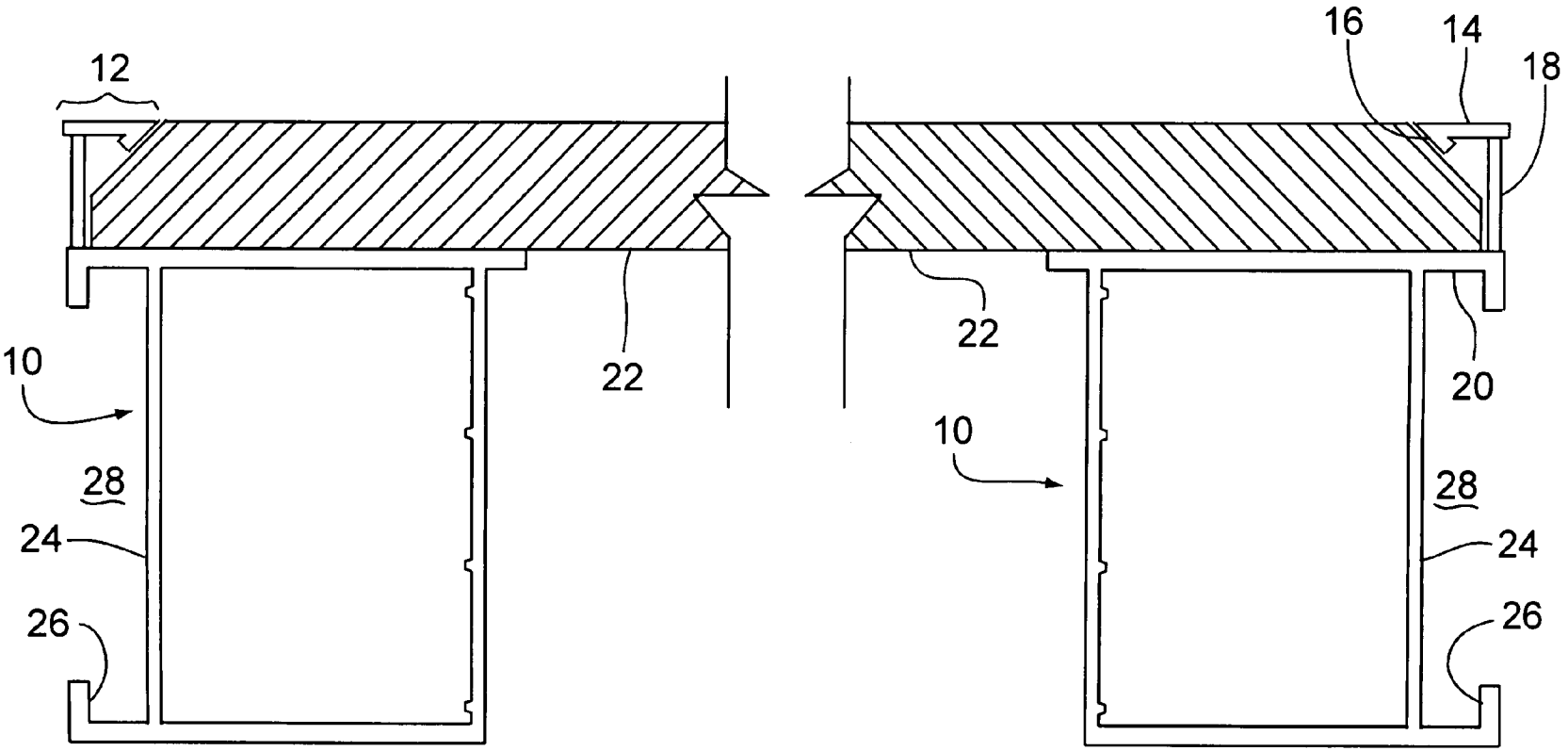
FIG. 1 is an end view showing the shaped cross section of the frame member used with the guard rail lock assembly of this invention.

FIG. 1 shows and end view of performance stage frame member 10 having shaped cross-section 12 wherein frame member 10 includes top lip 14 and chamfer 16 extending from top lip 14. Preferably, chamfer 16 is a beveled edge angularly extending inwardly and downwardly from top lip 14. Typically, top lip 14 and chamfer 16 form a 45° angle. Frame member 10 further comprises vertically extending back surface 18 with top lip 14 extending inwardly and horizontally from back surface 18. Frame member 10 further comprises bottom lip 20 extending inwardly and horizontally from the back surface.

The performance stage deck is stage deck 22 and a plurality of frame members 10 wherein the plurality of frame members capture and support the stage deck. Stage deck 22 is flush with top lip 14. No fasteners are required to connect stage deck 22 to frame members 10. Stage deck 22 has a flat top surface and the plurality of frame members 10 have a flat top surface. As a result, the flat surfaces are in a horizontal alignment with each other. A performance stage deck typically comprises a plurality of performance stage desks interlocked together to form a substantially continuous performance surface. If desired, however, additional legs may be used.

FIG. 1 further shows that frame member 10 comprises vertically extending back surface 24 and outwardly extending shape 26 defining multifaceted cavity 28 therebetween. Preferably, outwardly extending shape 26 is a C-shape.

Figure 2:
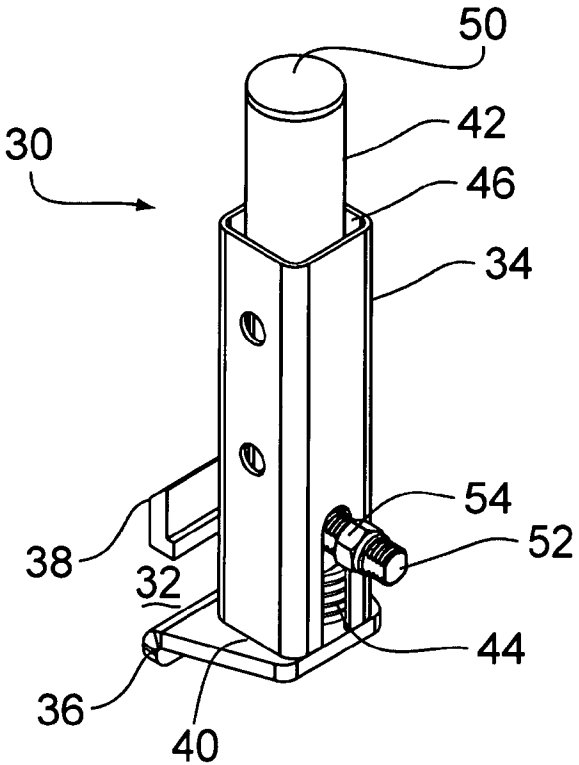
FIG. 2 is a perspective of the guard rail lock assembly of this invention.

FIG. 2 is a perspective of the guard rail lock assembly of this invention. FIG. 2 shows lock assembly 30 comprising an interlocking shape 32 wherein interlocking shape 32 is configured to engage multifaceted cavity 28 of outwardly extending shape 26 of frame member 10. Lock assembly 30 further comprises tubular vertical member 34 which, when engaged, is parallel to vertically extending back surface 24 of frame member 10. Lock assembly 30 further comprises first cross bar 36 and second cross bar 38. Cross bars 36 and 38 define interlocking shape 32. First cross bar 36 and second cross bar 38 are configured to engage outwardly extending shape 26 of frame member 10. First cross bar 36 is attached to bottom end 40 of tubular vertical member 34. Second cross bar 38 is vertically, slidably attached to tubular vertical member 34. Preferably, vertical plunger 42 is slidably housed in tubular vertical member 34. Second cross bar 38 is fixedly attached to vertical plunger 42. Vertical spring 44 is housed between vertical plunger 42 and bottom end 40 of tubular vertical member 34. Tubular vertical member 34 further comprises top section 46 having an orifice therein. Plunger 42 extends through orifice 46. Vertical spring 44 has a dimension smaller than a bottom section of plunger 42 thereby retaining vertical spring 44 within a space defined by tubular vertical member 34. Vertical plunger 42 has distal end 50 extending through orifice 46 of top section of tubular vertical member 34.

Figure 3:
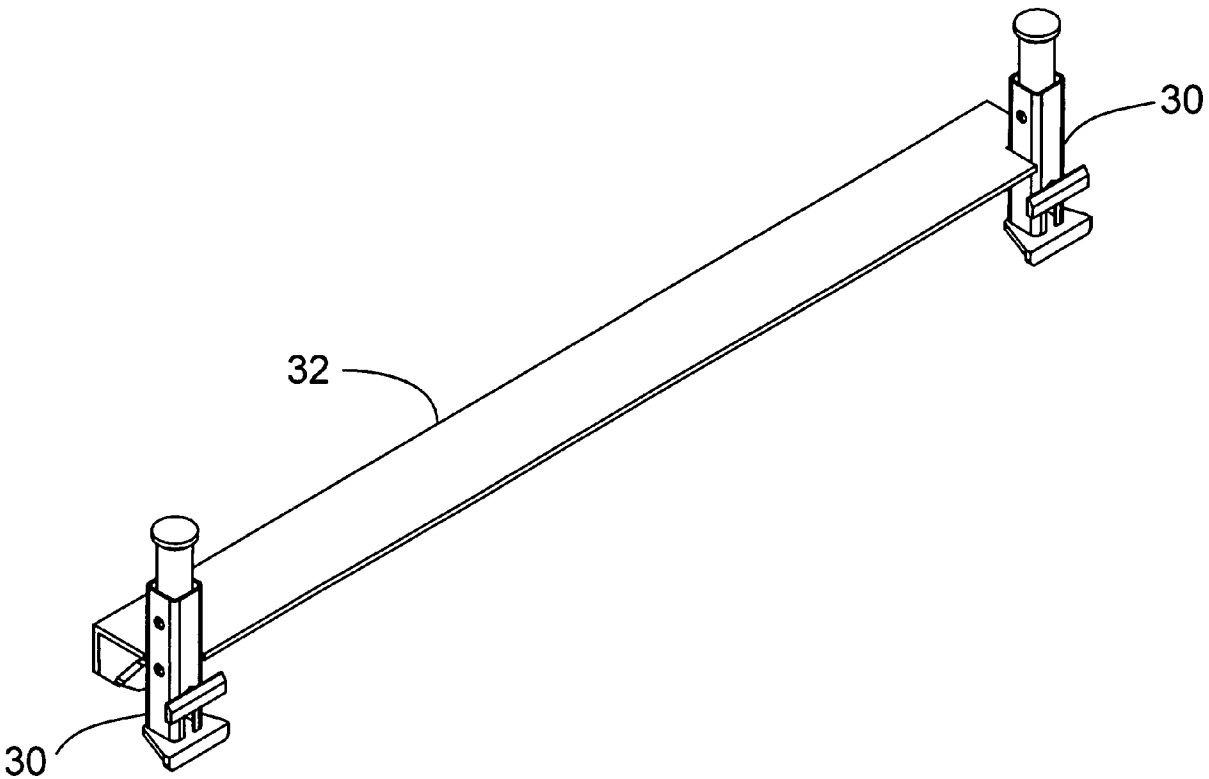
FIG. 3 is a perspective view showing the guard rail lock assembly connected to a stair adaptor of the stage.

FIG. 3 is a perspective view showing the guard rail lock assembly connected to a stair adaptor. Shown is two lock assemblies 30 attached to stair adaptor 32. Stair adaptor 32 then is attached to the stage.

Figure 4:
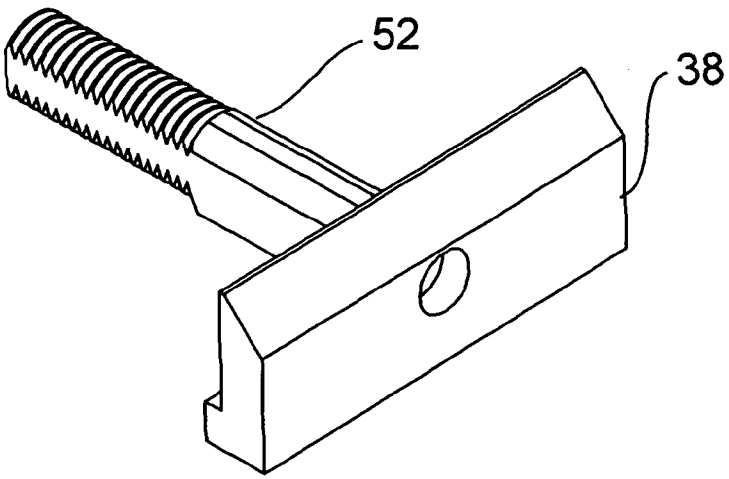
FIG. 4 is a perspective view of the T-lock component of the guard rail lock assembly.

FIG. 4 is a perspective view of the T-lock component of the guard rail lock assembly. Shown is second cross bar 38 attached to threaded shaft 52. Shaft 52 passes through orifices in tubular member 34 and orifices in a bottom end of plunger 50. Nut 54 secures shaft 52 to plunger 50.

Figure 5:
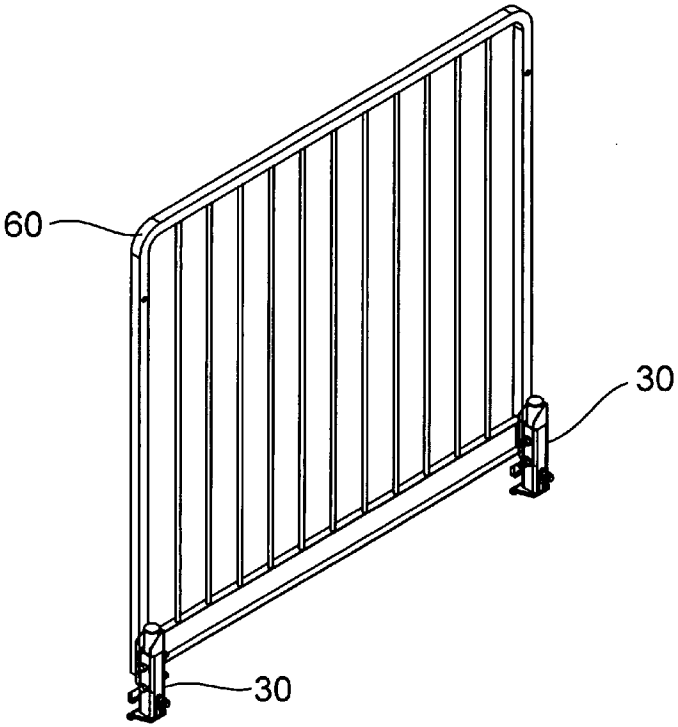
FIG. 5 is a perspective view of a guard rail panel.

FIG. 5 is a perspective view of a guard rail panel. Guard rail panel 60 is secured to lock assemblies 30.

Figure 6:
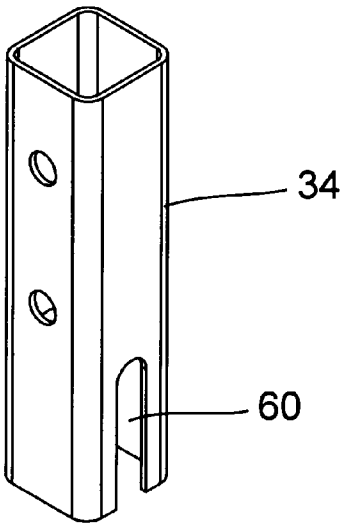
FIG. 6 is a perspective view of the tube guard-rail lock of this invention.

FIG. 6 is a perspective view of the tube guard-rail lock of this invention. Shown is tubular member 34. Shaft 52 passes through orifice 60. Cross bar 38 and shaft 52 are free to move vertically in orifice 60 when pressure is applied to distal end 50 of plunger 42.

The frame member and lock assembly of this invention provides for easy assembly. One person can assemble the stage. Further, a board attached to the stage is not needed.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not limitative sense, the scope of the invention being defined by the appended claims.

I claim:

1. A performance stage assembly comprising a performance stage frame member and a lock assembly;

wherein the performance stage frame member has a shaped cross-section, a vertically extending back surface and an outwardly extending shape defining a multifaceted cavity therebetween; and wherein the lock assembly comprising an interlocking shape wherein the interlocking shape is configured to engage the multifaceted cavity of the outwardly extending shape of the frame member, and wherein the lock assembly further comprises a tubular vertical member which, when engaged, is parallel to the vertically extending back surface of the frame member.

2. A stage assembly according to claim 1 wherein the frame member further comprises a shaped cross section extending inwardly wherein the inwardly extending cross section includes a top lip and a chamfer extending from the top lip, wherein the inwardly extending shaped cross section is configured to support a stage deck.

3. A stage assembly according to claim 2 wherein the chamfer is a beveled edge angularly extending inwardly and downwardly from the top lip.

4. A stage assembly according to claim 3 wherein the top lip and chamfer form a 45° angle.

5. A stage assembly according to claim 1 wherein outwardly extending shape is a C-shape.

6. A stage assembly according to claim 5 wherein the lock assembly further comprises a first cross bar and a second cross bar.

7. A stage assembly according to claim 6 wherein the first cross bar and second cross bar are configured to engage the outwardly extending shape of the frame member.

8. A stage assembly according to claim 6 wherein the first cross bar is fixedly attached to a bottom end of the tubular vertical member.

9. A stage assembly according to claim 6 wherein the second cross bar is vertically, slidably attached to the tubular vertical member.

10. A stage assembly according to claim 6 further comprising a vertical plunger slidably housed in the tubular vertical member wherein the second cross bar is fixedly attached to the tubular plunger.

11. A stage assembly according to claim 10 further comprising a vertical spring housed between the vertical plunger and a bottom end of the tubular vertical member.

12. A stage assembly according to claim 11 wherein the tubular vertical member further comprises a top section having an orifice therein wherein the plunger extends through the orifice.

13. A stage assembly according to claim 12 wherein the vertical spring has a dimension smaller than a bottom section of the plunger thereby retaining the vertical spring within a space defined by the tubular vertical member.

14. A stage assembly according to claim 12 wherein the vertical plunger has a distal end having a dimension larger than the orifice of the top section of the tubular vertical member.

* * * * *